United States Patent [19]

Westhead

[11] 4,394,413

[45] Jul. 19, 1983

[54] FLAME RETARDANT DRYER FABRICS

[75] Inventor: William T. Westhead, Waycross, Ga.

[73] Assignee: Scapa Dryers, Inc., Waycross, Ga.

[21] Appl. No.: 232,678

[22] Filed: Feb. 9, 1981

[51] Int. Cl.[3] ..... B32B 7/00

[52] U.S. Cl. ..... 428/257; 34/116; 34/123; 139/383 A; 428/245; 428/258; 428/259; 428/262; 428/920

[58] Field of Search ..... 428/257, 258, 259, 260, 428/262, 265, 267, 268, 920, 273; 252/8.6, 8.8; 139/383 A; 34/116, 123

[56] References Cited

U.S. PATENT DOCUMENTS

| | | |
|---|---|---|
| 3,791,854 | 2/1974 | Miles et al. . |
| 3,877,974 | 4/1975 | Mischutin . |
| 3,911,189 | 10/1975 | Miller . |
| 3,955,032 | 5/1976 | Mischutin . |
| 4,063,884 | 12/1977 | Miller . |
| 4,104,433 | 8/1978 | Kirk et al. . |
| 4,151,322 | 4/1979 | Rosenthal et al. . |
| 4,178,409 | 12/1979 | Tomita . |

*Primary Examiner*—James J. Bell

*Attorney, Agent, or Firm*—Fleit, Jacobson & Cohn

[57] ABSTRACT

The present invention is directed at modifying a resin-treated dryer fabric in such a way that its scaffolding effect is reduced or eliminated. Further, according to the teachings of the present invention, the resin used to coat the dryer fabric is itself made self-extinguishing, such that even if the fabric acts as a scaffold, the resin will not burn. Even further, a degree of flame retardancy is imparted to the base fabric in those cases where the base fabric itself is not self-extinguishing. A dryer fabric in which the woven fabric material is treated with an admixture of flame retardant material and resin, such that the flame retardant and resin are added to either the yarns of the fabric or the woven fabric at the same time. The admixture may take the form of a solution, a suspension, a colloidal suspension, a dispersion or an emulsion of flame retardant material and resin. The flame retardant material is preferably a water soluble material having an active phosphorous ingredient, preferably at the 15% level. The retardant material, in some cases, can also be a high bromide content material.

24 Claims, 3 Drawing Figures

FIG. 1
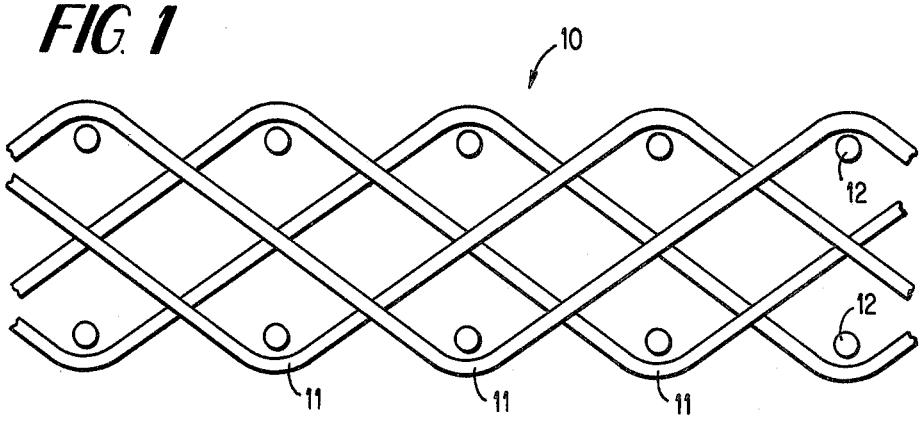
FIG. 2
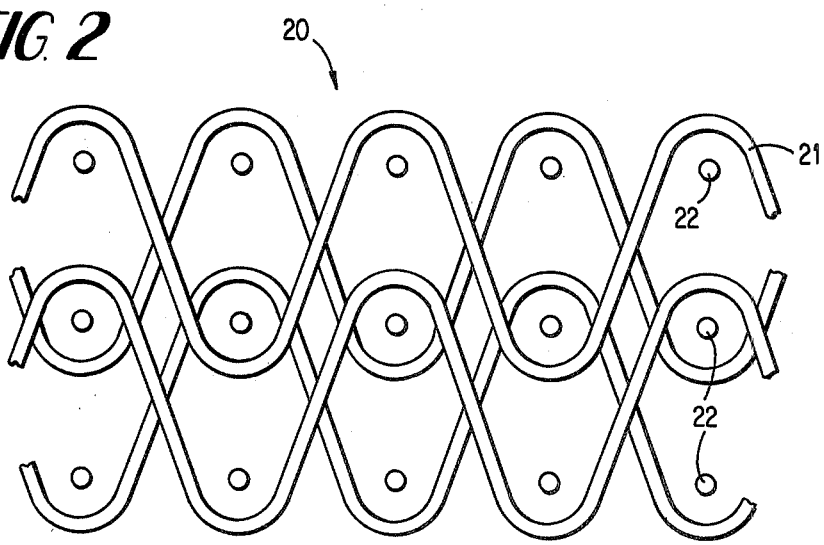
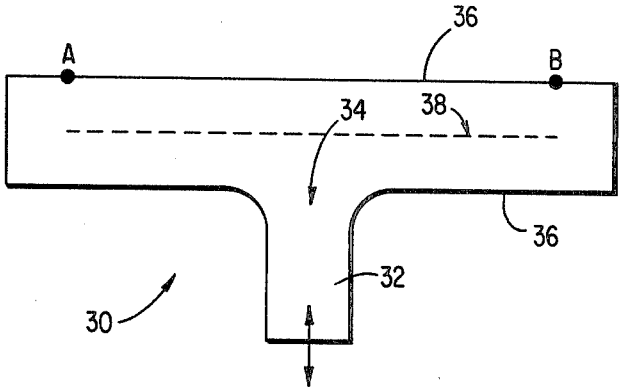
FIG. 3

FLAME RETARDANT DRYER FABRICS

BACKGROUND OF THE INVENTION

1. Field of the Invention

This invention generally relates to improvements in papermakers belts. More particularly, the invention relates to the flame-proofing of a resin-treated dryer fabric.

In the papermaking operation, the newly formed paper web must be dried after initially pressing it, in completion of the removal of water. As the paper web passes through the dryer section of a papermaking machine, it is guided throughout its passage by either a single or a pair of fabrics supported on rolls and known as dryer felts or fabrics. The paper web passes between the felts, and the dryer cylinders and exits the dryer unit. One of the great dangers in all papermaking operations is that of fire. The danger of fire is especially acute in the drying operation, due to the heating involved, and the start-up and shut-down involved. There is an ever-present danger that the drying fabrics, because they remain in the dryer and are continuously subjected to heat, will catch fire. Another possible cause of fire is static discharge, where a spark may ignite the dust or paper fines in the atmosphere or on the fabric. One approach to minimize fabrics catching fire is to modify the finished fabric to make it more difficult to catch fire, and if it does, then also to make the fabric more rapidly self-extinguishing.

In regard to the flame retardant properties of fabrics, it is well known that blends or combinations of materials will tend to be more flammable than their individual components. For example, a fabric, woven from thermoplastic yarns such as polyester, is relatively slow to propagate flame and is often self-extinguishing because the molten polymer constituting the yarn withdraws from the flame and/or melts and drips away, thereby removing the flame from the burning zone.

On the other hand, once fiber blends are employed in a fabric, the less fire resistant material burns, while the more fire resistant material acts as a scaffold preventing the withdrawal, dripping or falling away of the less fire resistant material. This is known as the scaffolding effect, and it is primarily found in blends and combinations of yarns.

Generally, when a fabric is resin-treated, the non-melting resin acts as a scaffold and the total fabric burns vigorously. Because the scaffolding effect was not originally clearly recognized, it was thought that flame-proofing of the resin would prevent or inhibit burning of resin-treated fabrics; however, such was not the case. Once the scaffolding effect was recognized, it seemed reasonable to attempt to flame-proof the basic material, such that, even if the resin were present, the basic material would not burn. This approach was also not successful, because the scaffolding effect continued to work, but in reverse, with the basic fabric material (now flame-proofed) acting as the scaffold. Thus, a flame-proof polyester fabric prior to resin coating would not burn, whereas after resin coating, the composite burned, with the fabric acting as the scaffold and the resin burning slowly.

With regard to the flame-proofing materials in general, the use of phosphorous, antimony oxide, and brominated compounds as flame retardants has been known for some time. However, the basic application of flame-proofing has been in the apparel or clothing art where a resin is added to prevent the removal of the flame retardant during laundering. Thus, for example, resins such as polyurethane, latex or chlorinated paraffin were found suitable for addition to fabrics which had been flame-proofed to aid in retention of fire proof properties. It was also known to flame-proof polyester fibers by incorporating distinct phosphorous compounds, for example, phosphorates or certain diphosphonic acids into the chain molecules. Further, flame retardant methods applicable to fiber blends were based upon additives being incorporated in the individual components of the blend.

However, the prior art fire-proofing was not developed in the direction of resin-treated dryer fabrics, and thus, did not provide a solution to the above-mentioned problem with regard to the burning of resin-treated dryer fabrics. Further, in the prior art dealing with clothing or apparel, the resin is of secondary importance as it is merely an aid to retention of the fire retardant agent in the fabric, and therefore the resin is generally chosen to be compatible with the flame retardant; whereas in the case of dryer fabrics, the resin is of primary importance for imparting fabric stability, wear and abrasion resistance, heat and hydrolysis resistance, resistance to chemical attack, oil and dirt resistance, and modulus properties to the fabric. There is thus a need for a resin-treated dryer fabric exhibiting flame-proof characteristics. There is also a need for providing a solution to the flame-proofing problem peculiar to resin-treated dryer fabrics. The present invention is directed toward filling those needs.

SUMMARY OF THE INVENTION

The present invention is directed at modifying a resin-treated dryer fabric in such a way that its scaffolding effect is reduced or eliminated. Further, according to the teachings of the present invention, the resin used to coat the dryer fabric is itself made self-extinguishing, such that even if the fabric acts as a scaffold, the resin will not burn. Even further, a degree of flame retardancy is imparted to the base fabric in those cases where the base fabric itself is not self-extinguishing.

The above is effected by treating the woven fabric material with an admixture of flame retardant material and resin, such that the flame retardant and resin are added to either the yarns of the fabric or the woven fabric at the same time. The admixture may take the form of a solution, a suspension, a colloidal suspension, a dispersion or an emulsion of flame retardant material and resin. The flame retardant material is preferably a water soluble material having an active phosphorous ingredient, preferably at the 15% level. The retardant material, in some cases, can also be a high bromide content material, as will be more fully explained in the description which follows.

Thus, it is a primary object of the present invention to successfully flame-proof the yarns or blends of yarns in resin coated dryer fabrics.

It is a further object of the present invention to form a resin-treated dryer fabric where the resin will continue to give the required fabric properties of modulus and stability, while not acting as a scaffold when the fabric is ignited.

It is another object of the present invention to provide a dryer fabric which burns for a shorter period of time and has improved self-extinguishing properties than has heretofore been possible.

It is still an object of the present invention to increase the ignition time, reduce the time of burning, and reduce the amount of fabric burnt when a flame is applied to a resin-treated dryer fabric.

THE DRAWINGS

FIG. 1 shows a two-layer woven fabric embodying the teachings of the present invention.

FIG. 2 shows a three-layer woven fabric embodying the teachings of the present invention.

FIG. 3 is a schematic plan view of the configuration of a fabric sample used to test certain properties of the subject invention.

DETAILED DESCRIPTION OF THE PREFERRED EMBODIMENTS

The present invention contemplates the use of a flame retardant composition that provides superior flameproofing for dryer fabrics, without adversely effecting fabric stability, wear and abrasion resistance, heat and hydrolysis resistance, resistance to chemical attack, oil and dirt resistance, and modulus. A dryer fabric embodying the teachings of the subject invention burns for a shorter period of time and has improved self-extinguishing properties than has heretofore been possible.

According to the subject invention, superior flameproofing of a resin-treated yarn or fabric is obtained by adding the flame retardant to the resin, and applying the resultant composite to either the fabric or the yarn (before weaving it into a fabric). The admixture of resin and flame retardant results in the resin being modified such that its scaffolding effect is reduced or eliminated. Further, the resin itself becomes self-extinguishing, so that even if the fabric base acts as a scaffold, the resin will not burn. Finally, a degree of flame retardancy is imparted to the base fabric (or yarn) in the cases where the base fabric itself is not self-extinguishing. Therefore, the time required to ignite the resin-treated fabric is increased, the amount of fabric which is burned is reduced, and the fabric is self-extinguishing. This aspect of the invention also results in the flame retardancy being effective as long as the resin is effective, since the flame retardant is an integral part of the resin. This is of particular importance in a dryer fabric, because, when the resin is no longer effective, the dryer fabric should be replaced.

As pointed out above, the present invention relates to a dryer fabric, which is treated with a resin, and in addition is flame-proofed. The dryer fabric of the present invention is generally a fabric which is woven flat or endless by conventional methods. The fabric includes both machine direction and cross-machine direction yarns. The yarns constituting the fabric can be made from one or more materials, or from a blend of materials. Thus, the yarn might be made from polyester, a blend including a polyester, nylon, an aramid fiber, such as that sold under the trademarks of Nomex and Kevlar, acrylic, glass, or any other material which may be incorporated into a dryer-fabric weave, and which will provide the properties required for a dryer felt or fabric.

One such fabric 10 is illustrated in FIG. 1. In FIG. 1, 11 indicates the machine direction yarns, whereas 12 indicates the cross-machine direction yarns. The machine direction yarns may comprise, for example, polyester or combinations of synthetic yarns; whereas the cross-machine direction yarns may comprise glass/synthetic, polyester, or glass yarns.

FIG. 2 illustrates a three-layer fabric 20 which can be used in connection with the present invention. Obviously, any number of layers can be used for the fabric of the invention, and FIGS. 1 and 2 are merely for illustrative purposes. Reference numerals 21 and 22 indicate machine direction and cross-machine direction yarns, respectively.

The resin preferably should be a material which can be applied to either the yarn or the fabric. Likewise, the resin preferably should provide fabric stability, wear and abrasion resistance, heat and hydrolysis resistance, resistance to chemical attack, modulus, and oil and dirt resistance. The resin also should be one which can withstand the high temperatures used in the papermaking dryer unit. The resin should be either water soluble or water miscible, and can be any of the standard resins generally used for dryer fabrics, such as the known epoxy and acrylic resins.

The resin is generally provided in fluid or liquid form, and may be applied to the fabric or yarn in any known manner. Thus, it is standard procedure to apply the resin to the fabric by lick-roll. Further, the resin might be sprayed, sprinkled, or even poured onto the yarn or fabric, or the fabric might be immersed in the resin. It is even possible to pass the yarn or fabric through a fluidized current or bed of the resin. The resin, which coats the fabric or yarn, may or may not impregnate the fabric or yarn, depending upon the desired final product.

The flame retardant is preferably a water-soluble flame retardant having phosphorus as an active ingredient (although a specific bromine active retardant can be used in certain cases as will be discussed later). The phosphorus is present at a level of 5–50%, while it is preferably present at a level of 10–20%. The phosphorus is most preferably present at the 15% level. The preferred form of the phosphorous active fire retardant of the invention is Polygard 123, which was developed by and is marketed by Hamilton-Auslander MFG. Co., Inc. The product is a complex phosphonate ester and contains no halogens or solvents. Polygard 123 is a clear, yellow liquid having 15% phosphorus as an active ingredient, and 70% solids. It is essentially nonionic, and has a pH of 3.0 to 3.5. The product is readily soluble in water and can be stored for many months without adverse effects. It has good thermal stability and a low volatility. Although Polygard 123 is preferred, any phosphonate ester like Polygard 123 can be used in accordance with the present invention, it being a primary requirement that the retardant, for most applications, have a high phosphorous content.

The Polygard 123 resin exhibits the following properties which make it a superior product in combination with the resin when applied to dryer felts (or yarns for such felts). The Polygard retardant is readily miscible with standard dryer fabric resins, and does not affect resin properties (such as those discussed above). The retardant does not cause nucleation of dyestuffs which are conventionally added to standard fabric resins. The retardant does not exhibit adverse toxicological properties. Thus, it can be handled without danger of contact with eyes, skin, and clothing; and it does not result in pollution of the environment. Therefore, Polygard 123 retardant is especially suitable for combination with the dryer fabric resin. In addition to this, superior properties for the final product are obtained when using the Polygard 123 retardant, as will be discussed in the next paragraph.

It has been observed that, when Polygard 123 retardant is combined with the resin added to the dryer fabric (or yarn), the final fabric is more difficult to ignite, burns for a shorter time, and there is an increase in the amount of undamaged material present at the end of the burning period. In addition, quite unexpectedly, an increase in the flexibility of the final dryer fabric is obtained. This increase in flexibility permits the fabric to hug the rolls on a papermaking machine in a superior manner, and provides better guidability of the fabrics in the dryer unit. The use of Polygard 123 in the final product, as per the invention, provides better flexibility both with respect to resin-treated fabrics without fire retardants and to resin-treated fibers to which bromine flame retardants were added. However, the specific bromine retardant, which will be later discussed, is considered to provide superior flame-proofing in certain cases and where flexibility is not so important, and that retardant, when used in the specific cases to be later discussed, is also considered to be a part of the invention, though not the most preferred embodiment.

The following examples illustrate the superior nature of the present invention, and also point out the characteristics of the final product of the present invention.

EXAMPLE 1

Two standard polyamide/epoxy resin mixes were prepared at 5% and 9% resin solids concentrations, the percentage being based upon weight of total resin mix. Quantities of both resin mixes were then run off into beakers and appropriate dyestuffs (blue, green, yellow, red, orange, and bordeaux) were then added to the resin mixes, and the composites obtained were thoroughly mixed. There were now 12 beakers, and each beaker full was then poured equally into five smaller beakers. Five flame retardant additives were then added, one to each beaker, at the recommended starting concentration. The recommended starting concentration was that of the flame retardant being 10% of the total resin weight. After addition of the flame retardant additives, their effect, if any, on the resin mix was noted.

The five flame retardant additives were:

1. Polygard 123, marketed by Hamilton-Auslander Mfg. Co., Inc. of West Warwick, Rhode Island. The properties of this phosphonate ester were discussed above.
2. RS-9300, marketed by Formulated Resins Inc. of Greenville, Rhode Island. This organic brominated retardant is based upon tightly cross-linked organic benzene rings. It contains a bromine content of 83%, with no phosphorus being present. It is a white powder, is non-mutagenic and is not an eye or skin irritant.
3. Fyrol 99, marketed by Stauffer Chemicals of New York, New York. This flame retardant is an organic product containing chlorine and phosphorus. It contains 14% phosphorus and 26% chlorine. It is clear to slightly opalescent, and is a nearly colorless syrup.
4. NBV 110, marketed by National Bio-Vin Corp. of Cleveland, Ohio. This retardant is a stable aqueous emulsion which is easily diluted with water.
5. NBV 120 is also marketed by National Bio-Vin Corp. This retardant is a solvent-based mixture, easily emulsified in water. The basis for the effectiveness of both NBV retardants is their merged chemical cross-linkage of the molecular structure of (1) hexamethoxymethyemelamine and (2) 2, 3 dibromopropyl phosphate. The NBV retardants possess heat and light stability.

There was no visible effect on the resins, for the cases where Polygard 123, RS-9300, or Bio-Vin NBV 110 and NBV 120 were added. Addition of Fyrol 99 in the test sample, however, indicated nucleation in both the 5% and 9% resin concentrations. The nucleation tended to be present irrespective of the dyestuffs used. Thus, Fyrol 99 did not appear to be fully compatible with the standard resin, while Polygard 123, RS-9300, and the Bio-Vin retardants were found to be compatible.

Testing of the four retardants found to be compatible with the resin was continued as per Example 2.

EXAMPLE 2

The purpose of this example was to determine the degree of reduction of flammability in resin coated dryer fabrics for each of the flame retardants which were compatible with the resin.

Four woven fabrics (A through D) having warp and weft compositions, as indicated in Table 1, were provided. Forty strips were cut from each of the four samples in the warp direction, with each strip measuring 10 inches by 1 inch. Next, two batches of polyamide/epoxy resin were prepared (as in Example 1) with one being at 5% concentration and containing blue dyestuff, and the other being at 9% concentration and containing green dyestuff. Each batch was then subdivided into four separate batches, thus resulting in eight batches. Each of the four remaining flame retardants was added to one of the green and one of the blue batches, and thoroughly mixed. The flame retardants were added, such that each flame retardant was 10% based upon total resin weight. Five strips of each type of fabric mentioned above were then dipped in each resin batch containing a flame retardant, and permitted to air dry upon removal from the batch. This produced forty samples. At the same time, five samples of the same fabrics had been hand dipped in each of both resin concentrations prior to the addition of any flame retardant. These samples (the two sets of five samples) were used as controls. The results of the intermediate tests are given in Table 1.

The compositions for the warp and weft of each of the four woven materials were as follows:

Yarn A—100% continuous filament polyester.

Yarn B—combination of continuous filament nylon, acrylic, and polyester.

Yarn C—combination of continuous filament polyester with spun acrylic.

Yarn D—combination of continuous filament Kevlar and Nomex with spun acrylic.

Yarn E—combination of glass with continuous filament nylon and polyester.

The weft yarn and warp yarn for the fabrics of Table 1 were made from these materials.

The results shown in Table 1 clearly indicate that, for the samples tested, the Bio-Vin retardants did not perform satisfactorily as flame retardants, when used with a resin for treatment of a dryer felt material. The performance of RS-9300 was better than that of the Bio-Vin products in all cases, and was better than Polygard 123 for the Yarn D warp material. However, the tests show Polygard 123 to offer superior performance, with respect to the remaining materials. It is noted that the RS-9300 flame retardant failed when applied to Fabric C. In addition, tests using the RS-9300 high bromine content flame retardant in both epoxy and, later, acrylic resins showed that the flexibility increase obtained for fabric treated with RS-9300 retardant was markedly less than that obtained for the Polygard 123 treated fabric. Testing of the RS-9300 retardant and the Polygard 123 retardant with regard to flexibility of the treated fabric is discussed in greater detail hereinafter. It can be seen that fabric treated with the Polygard 123 retardant has a much lower stiffness than fabric treated with the RS-9300 retardant. In fact, fabric treated with the RS-9300 retardant has a stiffness which is quite similar to the control fabric that had no retardant added to the resin at all.

The increase in flexibility offered by Polygard 123, as opposed to RS-9300 is especially important with respect to dryer fabrics, since, as discussed above, the flexibility enables the fabrics to hug the rolls on a paper machine better and to be guided by the rolls better.

There is no reason to expect that Polygard 123 will offer both increased flame resistance and flexibility; yet, the present invention takes advantage of this. It is further noted, that the Polygard 123 retardant was effective for all materials treated.

EXAMPLE 3

This example deals with the effect of the concentration of the flame retardant, with respect to the resin. In view of the superiority of Polygard 123, it was found advantageous to determine the preferred compositions, for which the Polygard 123 was most effective. In the previous example, the Polygard 123 was added at a level of 10% based upon total resin weight. In this example, trials were carried out at the 5% and 15% additive levels, based upon total weight of resin, and the results were compared with those obtained previously for the control (no flame retardant added to the resin) and the 10% additive level. The procedure followed was the same as that in the previous example, and the results are given in Table 2.

Table 2 shows that, at the 5% additive level, the reduction in burning in the fabrics made from Yarns C or D was small (12 to 34 seconds less than for the control). However, for the fabrics made from Yarns A or B, which have no spun yarn component, the reduction in burning time was marked and involved a decrease of 143 to 216 seconds with respect to the control. The addition of 10% or 15% Polygard showed a relatively marked improvement over the 5% level, for Yarn C or D fabrics, but a much smaller improvement for Yarn A or B fabrics. At the 15% additive level, the fabrics showed some degree of tackiness, possibly due to there being an excess of unreacted additive therein. The use of 15% Polygard 123 is therefore not preferred; however, it is within the scope of the invention. The preferred range for the additive level of Polygard 123 in the present invention is within the range of 5–12%, while the most preferred range is 8–12%.

EXAMPLE 4

This example deals with the effect of using the Polygard-treated polyamide/epoxy resin on the physical properties of a finished fabric. A fabric such as illustrated in FIG. 1 was tested.

In order to evaluate the physical properties of the fabric of FIG. 1, a standard sample of same was woven 15 ft. long and 108 inches wide, and was heat stabilized. A polyester continuous filament was used for both the warp and weft yarn of the two-layer fabric of FIG. 1. The sample was then cut into three sections, each being 15 ft. by 36 inches, and the pieces were sewn together to give a final piece of 45 ft. by 36 inches, which final piece was treated with a 9% polyamide/epoxy resin containing Polygard 123 at 10% of the total weight of resin.

The resin concentration and Polygard 123 addition was calculated with respect to the following. The weight of the sample was 34.5 lbs. (4.1 oz./sq. ft.). The weight of the resin, based upon a 70% pick-up by the fabric was 24.15 lbs. and this amounted to 2.4 gallons of such. A small trough was substantially filled with resin in the amount of 5.0 gallons. The total weight of resin used was therefore 50 lbs. Thus, 5 lbs. of Polygard 123 were added to the water in the tank prior to the addition of the resin mix. The fabric was treated with the fire retardant-modified polyamide/epoxy resin in the standard manner and dried, after which it was evaluated against an identically woven control fabric which had been resin treated in the same manner, but where the Polygard 123 was not added. The control is designated in the tables which appear below as "standard", while the fabric containing the Polygard-treated resin is designated as "sample".

The sample was evaluated for its standard physical properties in the tables which follow.

| Physical Properties | | |
|---|---|---|
| Property | Sample | Standard |
| Warp strength (lbs) | 962 | 1021 |
| Warp elongation at break | 54.7 | 50.0 |
| Weft strength | 1321 | 1242 |
| Weft elongation at break | 23.2 | 28.3 |

Physical properties of the sample were acceptable. The physical properties of the standard and sample were determined by use of an Instron Tensile Tester with 12 inch/min. chart speed and 12 inch/min. cross-head speed. The sample length between the jaws of the Instron tester was 10 inches. The sample was tested under standard conditions.

The modulus of both the sample and standard fabrics was measured in the hot and wet condition and gave the following results:

| Modulus | | | |
|---|---|---|---|
| | | Sample | Standard |
| Warp elongation at | 5 lbs. | 0.5% | 1.2% |
| | 10 lbs. | 0.9% | 1.4% |
| | 15 lbs. | 1.1% | 1.6% |
| | 20 lbs. | 1.2% | 1.8% |
| | 25 lbs. | 1.5% | 1.9% |
| | 30 lbs. | 1.6% | 2.1% |

The results indicate that the resistance to stretch is unexpectedly better for the sample than for the standard Scaperm. The modulus was measured using a standard procedure in which an Instron Tensile Tester was again used, with a 10 inch/min. chart speed and 1 inch/min. cross-head speed. The sample length between the jaws of the Instron tester was 5 inches.

Next, the construction of the sample and standard were evaluated, and the following was found.

| Construction | | |
|---|---|---|
| | Sample | Standard |
| Finished ends/inch | 64 | 63 |
| Finished picks/inch | 26.5 | 26.0 |
| % warp | 56.3 | 55.8 |
| % weft | 43.7 | 44.2 |
| Weight | 4.52 | 4.44 |

-continued

| | Construction | |
|---|---|---|
| | Sample | Standard |
| Thickness | 0.82" | 0.81" |

Minor construction differences are within production standards, while the slight weight increase for the sample is at least in part due to the Polygard addition.

The permeability of the fabrics was then evaluated, with permeability being important since moisture will pass through the fabrics.

| Permeability | |
|---|---|
| Sample | 250–260 cfm |
| Standard | 270–280 cfm |

Based on the results obtained, change in permeability is considered insignificant.

The cyclic loading properties of the fabrics were then determined. Obviously, the fabric will undergo cyclic loading in the operation of the dryer unit in the papermaking system. Both the sample and standard fabrics were subjected to a standard cyclic loading test involving the following. With reference to FIG. 3, the sample 30 is cut 8 inches by 3½ inches with a tongue 32 protruding from the middle 34 of one of the 8-inch sides 36. Each cut piece is clamped at one side of the piece at A and B with a horse-shoe clamp which fits into the top jaw of the Instron Tensile Tester. The tongue 32 at the other side of the piece fits into the bottom jaw of the Instron tester. A straight start line 38 is drawn on the piece parallel to the 8-inch sides, and the piece is then automatically cyclically loaded from 0 to 350 lbs. (31.5 times per minute) for 1 hour. The distortion of the start line (drawn on the piece) from its original position is then measured under static loads of 0 to 350 lbs., giving results as shown in the below table. The lower the distortion, the better the stability. The following results were obtained:

| Cyclic Loading | | Deflection mm | |
|---|---|---|---|
| | | Sample | Standard |
| Load | 0 lbs. | 11.5 | 10.5 |
| | 50 lbs. | 17.5 | 21.5 |
| | 100 lbs. | 18.5 | 22.0 |
| | 150 lbs. | 19.0 | 23.0 |
| | 200 lbs. | 19.5 | 24.0 |
| | 250 lbs. | 20.5 | 24.5 |
| | 300 lbs. | 21.0 | 25.0 |
| | 350 lbs. | 21.5 | 26.0 |

The above shows that the stability of the fabric sample is superior to that of the standard.

It was further noted that the addition of the Polygard 123 had a softening effect on the resin. Fabric stiffness was measured using a standard Teledyne Stiffness Tester and gave the following results in Taber Stiffness Units:

| | Sample (Polygard 123) | Standard (Control) | RS-9300 |
|---|---|---|---|
| Warp stiffness 15° deflection | 72.4 | 85.5 | 83.2 |
| Weft stiffness 15° deflection | 227.7 | 276.3 | 269.8 |
| Warp: weft stiffness ratio | 1:3.15 | 1:3.23 | 1:3.24 |

The lower the deflection figure, the more flexible (and less stiff) the fabric.

It is noted that the ratio of warp-to-weft stiffness has been retained for the case of the Polygard-treated fabric, and therefore, the Polygard-containing sample should behave in a similar manner to that of the standard; this is confirmed by the above cyclic loading results. The fact that the Polygard-containing fabric is less stiff than the standard indicates flexibility. The fact that the sample (Polygard-containing fabric) is more flexible than the standard results in improvement with respect to fabric guiding and roll hugging. The increase in flexibility for the Polygard-treated fabric is thought to be a result of the softening effect on the resin caused by Polygard 123. The increase in flexibility and improvement in the stability of the fabric, due to the incorporation of Polygard 123 in the resin is an unexpected advantage which is obtained in addition to the superior fire-proofing properties exhibited by the fabric. Thus, it was unexpected that a flame retardant would yield improved properties (flexibility and stability) having nothing to do with flame retardancy. It was further unexpected that the Polygard 123 would provide a superior degree of fire-proofing, which was effective over a wide variety of dryer fabric yarns.

In order to ensure that the Polygard 123 provided increased flame-proofing for dryer fabrics, both the sample and the standard fabrics were subjected to the same flammability test as described in Examples 2 and 3 above. Burning time and length of unburnt sample remaining after the flame self-extinguished were measured giving the following results:

| | Flammability | |
|---|---|---|
| | Sample | Standard |
| Burning time (secs.) | 12.0 | 157 |
| Length remaining (in.) | 7.1 | 2.1 |

EXAMPLE 5

As a final trial, fabrics were treated with flame retardant chemicals prior to resin treatment, with the resin being added in the conventional manner after the flame retardant had contacted the fabric. The reduction in flammability in each case was at best marginal, even at high addition levels. Representative data for these tests are presented as follows:

| | | | Flame Retardant 10% Level | | | | | |
|---|---|---|---|---|---|---|---|---|
| | | | Control | | Polygard 123 | | RS-9300 | |
| Warp | Weft | Polyamide/ Epoxy Resin Concentration | Burn Time (secs) | Length Remains | Burn Time (secs) | Length Remains | Burn Time (secs) | Length Remains |
| Polyester | Polyester | 9% | 159 | 1.75 | 130 | 3 | 147 | 3.5 |
| Polyester/ acrylic/ | Glass/ polyester/ | 5% | 251 | 1.0 | 190 | 3.5 | 231 | 2.0 |

-continued

| Warp | Weft | Polyamide/ Epoxy Resin Concentration | Flame Retardant 10% Level: Control Burn Time (secs) | Control Length Remains | Polygard 123 Burn Time (secs) | Polygard 123 Length Remains | RS-9300 Burn Time (secs) | RS-9300 Length Remains |
|---|---|---|---|---|---|---|---|---|
| nylon | nylon | | | | | | | |
| Acrylic/ polyester | Glass/ polyester/ nylon | 5% | 139 | 0.8 | 120 | 2.5 | 140 | 3.0 |
| Acrylic/ Kevlar/ Nomex | Glass/ polyester/ nylon | 5% | 114 | 0.0 | 110 | 0.5 | 97 | 1.0 |

As pointed out above, the addition of the flame retardant together with the resin is a key consideration in the present invention, and results in a superior fire-proofed dryer fabric.

When the resin is added to the fabric first, and then the retardant is added, the retardant is not effective for a long period of time, since the retardant will disappear from the resin coated fabric both by diffusion and abrasion (removal from the surface by wear). However, where the retardant is added together with the resin, the retardant becomes an integral part of the resin finish, and will be effective as long as the resin is effective.

In a dryer fabric, once the resin is no longer effective, the fabric is useless. Therefore, the retardant will be effective for the useful life of the fabric. Tests involving the fabrics treated with Polygard-containing resins (Example 3) showed that the flame retardant was still effective after the fabric was stored for 12 months. Thus, there was no problem with diffusion of the Polygard flame-retardant. Since the Polygard 123 retardant does not diffuse out of the fabric, it remains part of the resin, and will be abraded out of the fabric only when the resin is abraded.

When the resin is added to the fabric after the fire-proofing agent is added, it is not sufficiently effective to impart fire-proofing properties to the resin which is later added. Therefore, although a degree of flame retardancy is imparted to the base fabric, the resin, nevertheless, will burn. Thus, the reduction in flammability is marginal, as is pointed out immediately above. It is only the addition of the flame retardant together with the resin which enables reduction or elimination of the scaffolding effect discussed above, in addition to imparting fire-proofing properties to both the resin and the base fabric.

Although Polygard 123 is the preferable fire retardant for addition in dryer felts as discussed above, the addition of RS-9300 is also effective in some cases and forms a part of the invention. Thus, from Table 1, it can be seen that RS-9300 retardant imparts a superior degree of flame-proofing when applied together with resin to Yarn A or Yarn D fabrics, where stability and flexibility are not paramount.

The use of flame-retardant resins as above-discussed has been described with respect to dryer fabrics. Of course, the use of the flame-retardant resins as discussed could be applied to any fabrics used in the paper-making process. For example, if required, the resin could be applied to forming fabrics made from synthetic monofils. However, the resin treatment of wet felts, such as press felts and forming fabrics are not the areas where fires generally start, and thus the use of the flame-retardant resins as per the invention would not be as suitable in these areas.

As pointed out above, the resin-flame retardant admixture can be added either to the yarn (before weaving) or to the fabric (after weaving). Further, the yarn can be treated with a resin-flame retardant admixture before weaving, and then the woven fabric can be treated with a resin-flame retardant admixture, where either the same or different resin and/or retardant is used. The choice in treating either the yarn or the woven fabric is to be determined by such considerations as the equipment available, and the nature of the resin-flame retardant admixture to be used. For example, the use of admixtures containing epoxy resins on yarns prior to weaving would not be preferred, because epoxies tend to cure and stiffen even at room temperature. A stiffened resin-treated yarn would prove difficult to weave. Therefore, where a double treatment with resin-flame retardant is desired, it would be preferred to use an acrylic-retardant admixture on yarns prior to weaving, followed by an epoxy-retardant admixture on the fabric after weaving.

The invention has been described in the above specification and illustrated by reference to specific embodiments and illustrative examples. However, it is to be understood that the invention is not to be limited by the embodiments or examples, and is to be limited only by the claims which follow. It is to be understood that changes and alterations in the specific details recited above may be made without departing from the scope or spirit of the invention disclosed herein.

TABLE 1

COMPARISON OF FLAME RETARDANT ADDITIVES

| Fabric | Warp | Weft | Polyamide/ Epoxy Resin Concentration | FLAME RETARDANT (10%): Control Burn Time (secs) | Control Length Remains | Polygard 123 Burn Time (secs) | Polygard 123 Length Remains | RS-9300 Burn Time (secs) | RS-9300 Length Remains | NBV 110 Burn Time (secs) | NBV 110 Length Remains | NBV 120 Burn Time (secs) | NBV 120 Length Remains |
|---|---|---|---|---|---|---|---|---|---|---|---|---|---|
| A | YARN A | YARN A | 9% | 159 | 1.75" | 14 | 7.9" | 35.8 | 8" | 120.3 | 3" | 121.2 | 3.5" |
| B | YARN B | YARN E | 5% | 251 | 1.0" | 26.9 | 8.6" | 85.0 | 7.6" | 151 | 4.5" | 142 | 4.2" |
| C | YARN C | YARN E | 5% | 139 | 0.8" | 50.5 | 6.5" | 172.0 | 0" | 146 | 0" | 157 | 0" |

TABLE 1-continued

COMPARISON OF FLAME RETARDANT ADDITIVES

| Fabric | Warp | Weft | Polyamide/ Epoxy Resin Concentration | FLAME RETARDANT (10%) Control Burn Time (secs) | Control Length Remains | Polygard 123 Burn Time (secs) | Polygard 123 Length Remains | RS-9300 Burn Time (secs) | RS-9300 Length Remains | NBV 110 Burn Time (secs) | NBV 110 Length Remains | NBV 120 Burn Time (secs) | NBV 120 Length Remains |
|---|---|---|---|---|---|---|---|---|---|---|---|---|---|
| D | YARN D | YARN E | 5% | 114 | 0.0" | 61.2 | 5.1" | 44.8 | 7.2" | 97.4 | 1.1" | 90.2 | 1.3" |

TABLE 2

EFFECT OF ADDITIVE LEVEL

| Fabric | Warp Yarn | Weft Yarn | Control Burn Time (secs) | Control Length Remaining | 5% Level Burn Time (secs) | 5% Level Length Remaining | 10% Level Burn Time (secs) | 10% Level Length Remaining | 15% Level Burn Time (secs) | 15% Level Length Remaining |
|---|---|---|---|---|---|---|---|---|---|---|
| A | YARN A | YARN A | 159 | 1.75" | 16 | 7.25" | 14 | 7.9" | 4.1 | 8.4" |
| B | YARN B | YARN E | 251 | 1" | 34.8 | 7.8" | 26.9 | 8.6" | 22 | 8.8" |
| C | YARN C | YARN E | 139 | 0.8" | 105 | 3" | 50.5 | 6.5" | 45.8 | 6.8" |
| D | YARN D | YARN E | 114 | 0" | 102 | 3" | 61.2 | 5.1" | 46.7 | 6.1" |

What is claimed is:

1. A flame retardant dryer fabric comprising:

a plurality of interwoven machine direction and cross-machine direction yarns; and an admixture of resin and flame retardant coating said machine direction and cross-machine direction yarns, said resin being chosen for its known ability to provide fabric stability, wear and abrasion resistance, heat and hydrolysis resistance, resistance to chemical attack, modulus, and oil and dirt resistance; said flame retardant being compatible with said resin; and said admixture being free of nucleation and being an integral part of said fabric.

2. The dryer fabric of claim 1, wherein said flame retardant is water soluble and contains phosphorus.

3. The dryer fabric of claim 1, wherein said resin is an acrylic or epoxy resin.

4. The dryer fabric of claim 1, wherein said flame retardant is present in an amount of approximately 5–15% based upon total weight of said resin.

5. The dryer fabric of claim 1, wherein the components of the machine direction and cross-machine direction yarns are selected from the group consisting of spun synthetic yarn material, non-spun synthetic yarn material, and combinations of spun and/or non-spun synthetic yarn materials.

6. The dryer fabric of claim 1, wherein the components of the machine direction and cross-machine direction yarns comprise polyester, glass, acrylic, nylon, aramid fiber, and mixtures thereof.

7. The dryer fabric of claim 1, wherein the warp yarn of the dryer fabric comprises 100% polyester or combinations of polyester and other synthetic yarns or combinations of other synthetic yarns not including polyester, and the weft yarn of the dryer fabric comprises glass/-synthetic yarn, polyester, or glass.

8. A flame retardant dryer fabric comprising a woven fabric including a plurality of machine direction yarns, each of said machine direction yarns being coated with a first admixture of both a first resin and a first flame retardant, and a plurality of cross-machine direction yarns, each of said cross-machine direction yarns being coated with a second admixture of a second resin and a second flame retardant, said coatings being applied prior to weaving said yarns into said dryer fabric.

9. The dryer fabric of claim 8, wherein said first and second resins are of the same resin material, said resins being chosen for their known ability to provide fabric stability, wear and abrasive resistance, heat and hydrolysis resistance, resistance to chemical attack, modulus, and oil and dirt resistance.

10. The dryer fabric of claim 9, wherein said resin material is acrylic or epoxy.

11. The dryer fabric of claim 8, wherein said first and second flame retardants are of the same flame retardant material, said flame retardants being compatible with their respective resins; said admixtures being free of nucleation, said flame retardant acting to soften said resin; and said admixture increasing the flexibility of said dryer fabric.

12. The dryer fabric of claim 8, wherein each of said first and second flame retardants are present in an amount of approximately 5–15% based upon total weight of their respective resins.

13. The dryer fabric of claim 8, wherein at least one of said admixtures further comprises at least one dyestuff.

14. The dryer fabric of claim 9, wherein each of said admixtures includes a resin solids concentration in the range of 5–9%, where percent is based upon the liquid resin mix.

15. The dryer fabric of claim 8, wherein at least one of said flame retardants is a complex phosphonate ester.

16. The dryer fabric of claim 15, wherein 15% phosphorus is present in said complex phosphonate ester.

17. The dryer fabric of claim 8, wherein at least one of said flame retardants is a compound having tightly cross-linked organic benzene rings, and having a high bromine content.

18. The dryer fabric of claim 17, wherein said compound contains at least 83% bromine and 0% phosphorus.

19. The dryer fabric of claim 8, wherein the components of the machine direction and cross-machine direction yarns are selected from the group consisting of spun synthetic yarn material, non-spun synthetic yarn material, and combinations of spun and/or non-spun synthetic yarn materials.

20. The dryer fabric of claim 8, wherein the components of the machine direction and cross-machine direction yarns comprise polyester, glass, acrylic, nylon, aramid fiber, and mixtures thereof.

21. The dryer fabric of claim 8, wherein the warp yarn of the dryer fabric comprises polyester or combinations of synthetic yarns, and the weft yarn of the dryer fabric comprises glass/synthetic yarn, polyester, or glass.

22. The dryer fabric of claim 1, wherein said flame retardant acts to soften said resin, and said admixture increases the flexibility of said fabric over that exhibited by said fabric without the addition of said flame retardant.

23. The dryer fabric of claim 9, further comprising a third admixture of both a third resin and a third flame retardant.

24. The dryer fabric of claim 23, wherein said third resin material is acrylic or epoxy, chosen for its known ability to provide fabric stability, wear and abrasion resistance, heat and hydrolysis resistance, resistance to chemical attack, modulus, and oil and dirt resistance; and wherein said third flame retardant is chosen so as to be compatible with said resin; said admixture being free of nucleation.

* * * * *